US006126764A

United States Patent [19]

Timmerman

[11] Patent Number: 6,126,764

[45] Date of Patent: Oct. 3, 2000

[54] POWDERED METAL PYROTECHNIC FUEL

[75] Inventor: Hubert G. Timmerman, Manhattan Beach, Calif.

[73] Assignee: Special Devices, Inc., Moorpark, Calif.

[21] Appl. No.: 09/392,968

[22] Filed: Sep. 9, 1999

[51] Int. Cl.[7] ..... C06B 27/00

[52] U.S. Cl. ..... 149/87; 149/19.1; 149/37; 149/42; 149/83; 149/108.2

[58] Field of Search ..... 149/87, 774, 108.2, 149/19.1, 37

[56] References Cited

U.S. PATENT DOCUMENTS

| | | | |
|---|---|---|---|
| 4,799,979 | 1/1989 | Baldi | 149/5 |
| 5,212,343 | 5/1993 | Brupbacher et al. | 102/323 |
| 5,339,624 | 8/1994 | Calsson et al. | 149/19.1 |
| 5,464,699 | 11/1995 | Baldi | 428/607 |
| 5,495,819 | 3/1996 | Marion | 149/19.1 |
| 5,936,195 | 8/1999 | Wheatley | 149/19.91 |

*Primary Examiner*—Charles T. Jordan
*Assistant Examiner*—Glenda L Sánchez
*Attorney, Agent, or Firm*—Lyon & Lyon LLP

[57] ABSTRACT

A pyrotechnic fuel material for a booster in a pyrotechnic system having an adjacent igniter. In one embodiment, a powdered $BaAl_4$ compound is used as the booster pyrotechnic fuel. In another embodiment, a powdered zirconium/nickel alloy is used as the booster pyrotechnic fuel. Both the powdered $BaAl_4$ compound and the powdered zirconium/nickel alloy exhibit ignition sensitivity thresholds on the order of millijoules, thereby allowing for increased safety in manufacturing and handling over elemental powdered metal pyrotechnic fuels normally used for the entire pyrotechnic system.

8 Claims, 1 Drawing Sheet

POWDERED METAL PYROTECHNIC FUEL

BACKGROUND OF THE INVENTION

The field of invention is pyrotechnics, and more specifically powdered metal alloys or compounds used as pyrotechnic fuel.

Pyrotechnic devices of various kinds, such as automotive airbag initiators, are commonly used in many applications. Such devices contain pyrotechnic fuel, which ignites and bums when combined with an oxidizer and exposed to an igniting force such as heat or an electric current, generating a burst of high pressure which in turn is converted to useful work of some kind. It is also known to use a pyrotechnic booster in conjunction with a primary pyrotechnic device, such that the pressure and/or heat released by the ignition of the primary pyrotechnic device in turn ignites the pyrotechnic booster.

Ultra-fine powders of elemental metals, such as aluminum, zirconium, or titanium, have been used as pyrotechnic fuels in primary pyrotechnic devices. These powders have a low ignition sensitivity threshold. That threshold is the amount of energy required to ignite a pyrotechnic material, usually measured in joules. Elemental metal fuels typically have an ignition sensitivity threshold on the order of magnitude of microjoules, so they require very little energy to ignite. Elemental metal fuels ignite rapidly upon reaching their ignition sensitivity threshold, then burn rapidly thereafter. Thus, they are desirable for use in applications where rapid ignition and burning are required. However, this low ignition sensitivity threshold means that these powdered elemental metals must be handled very carefully during manufacturing to prevent accidental ignition. Additionally, the ignition sensitivity threshold of powdered elemental metal fuels decreases as the average particle size of the powder grows smaller, necessitating even greater precautions in handling.

Such elemental fuels have also been used in the past in pyrotechnic boosters, with the same drawbacks. Additionally, hydrated compounds such as titanium hydride ($TiH_2$) and zirconium hydride ($ZrH_2$) have been used in pyrotechnic boosters. As with the elemental metal fuels, though, these hydrated compounds possess low ignition sensitivity thresholds.

SUMMARY OF THE INVENTION

An object of the present invention is to provide an effective pyrotechnic system principally comprised of a pyrotechnic material having a relatively high ignition sensitivity threshold for improving safety. In one embodiment of the invention, a powdered $BaAl_4$ compound is used as the principal pyrotechnic fuel material. In another embodiment of the invention, a powdered zirconium/nickel alloy is used as the principal pyrotechnic fuel material. Both the powdered $BaAl_4$ compound and the powdered zirconium/nickel alloy exhibit ignition sensitivity thresholds on the order of millijoules.

DETAILED DESCRIPTION OF THE PREFERRED EMBODIMENTS

Figure 1:
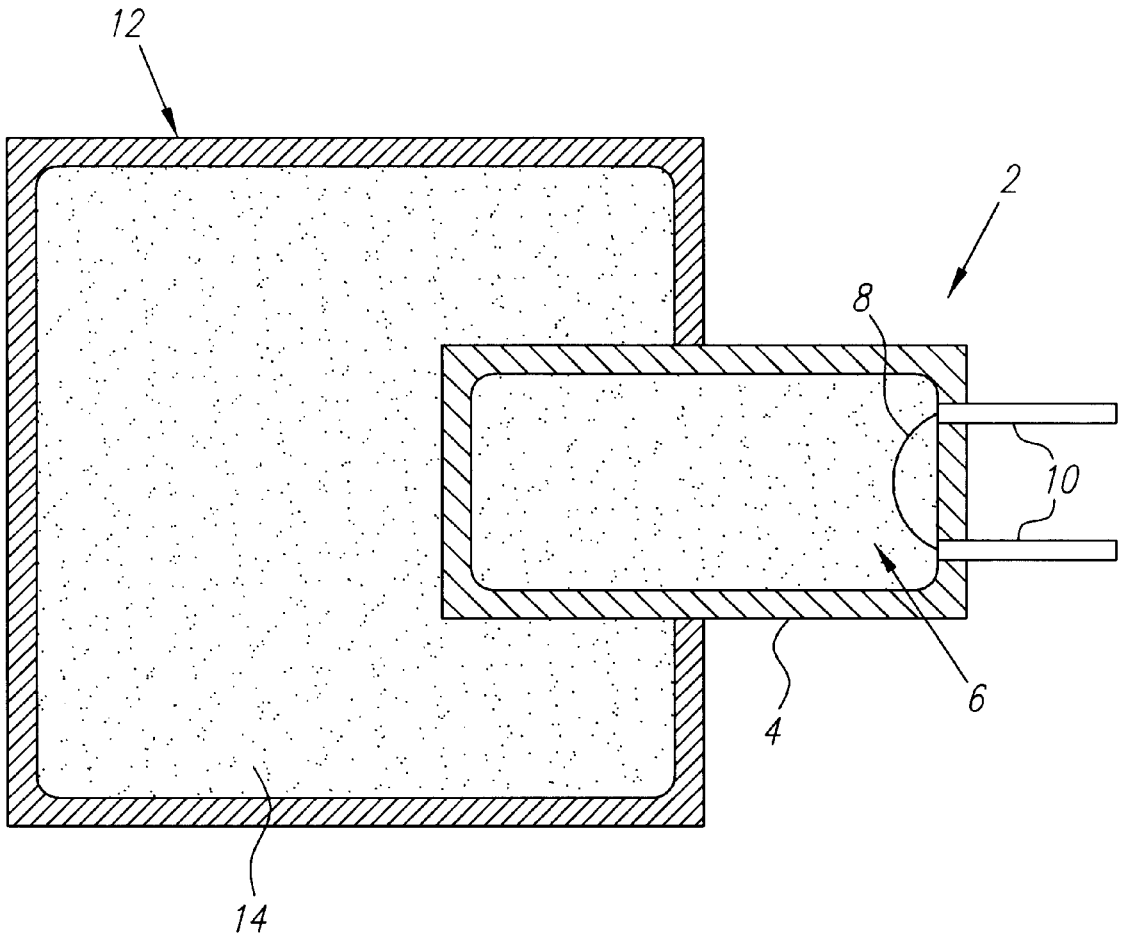
FIG. 1 is a cross-sectional schematic representation of a pyrotechnic system.

FIG. 1 shows a cross-section of a schematic representation of a pyrotechnic igniter 2, a common pyrotechnic device. Of course, pyrotechnic igniters can take other forms and be constructed in other fashions, but the pyrotechnic igniter 2 is convenient for illustrating the present invention.

An explosive can 4 encloses an igniter charge 6, preferably hermetically. A bridge wire 8 is present in the explosive can 4, preferably connected to two contacts 10. When an electric current is sent through the bridge wire 8, it heats up, transmitting energy to the igniter charge 6 and igniting it. Other structures than the bridge wire 8 may be used to ignite the igniter charge 6, and the use of such structures is within the scope of the present invention.

A booster 12 may be placed adjacent to the pyrotechnic igniter 2. The booster 12 is used in applications where more pressure or explosive force is desired than can be generated by the pyrotechnic igniter 2 alone. After the pyrotechnic igniter 2 is ignited, the igniter charge 6 begins to burn rapidly, generating heat and pressure that in turn cause a booster charge 14 inside the booster 12 to ignite as well. Preferably, the booster 12 is in contact with the pyrotechnic igniter 2. While FIG. 1 shows the pyrotechnic igniter 2 extending partly into the body of the booster 12, such a configuration is not required. Rather, the booster 12 and the pyrotechnic igniter 2 must simply be positioned relative to one another in such orientation and proximity that pressure and/or heat generated by the ignition of the igniter charge 6 is sufficient to ignite a booster charge 14 inside the booster 12.

In a first preferred embodiment, the booster charge 14 comprises a powdered barium/aluminum ($BaAl_4$) compound, an organic binder, and an oxidizer material. The $BaAl_4$ is present in molecular form; however, the presence of small amounts by weight of atomic barium or aluminum does not affect the performance of the $BaAl_4$ compound or alter its ignition sensitivity threshold. Preferably, the average size of particles of the $BaAl_4$ compound is 16 microns or less. The $BaAl_4$ compound has an ignition sensitivity threshold on the order of magnitude of millijoules, which is several orders of magnitude higher than the microjoule-level threshold of known elemental metal pyrotechnic fuels. The caloric value of the $BaAl_4$ compound is about 1400 calories/gram, which is comparable to known elemental metal pyrotechnic fuels. Preferably, the organic binder is one sold under the registered trademark VITON® B, a fluoroelastomer terpolymer commercially available from DuPont Dow Elastomers LLC. However, the particular type of organic binder used is not critical; many different types of organic binder are known, and selection of an appropriate organic binder is within the knowledge of one skilled in the art. Preferably, the oxidizer material is potassium perchlorate. In a preferred embodiment, the booster charge 14 comprises substantially 52±1% by weight of powdered $BaAl_4$ compound, substantially 3+0.1% by weight of VITONO® B binder, and substantially 45±1% by weight of potassium perchlorate. In another embodiment, the booster charge 14 comprises substantially 47±1% by weight of powdered $BaAl_4$ compound, substantially 3±0.1% by weight of VITON® B binder, and substantially 50±1% by weight of potassium perchlorate. Other proportions may be used so long as the ignition sensitivity threshold and burn rate of the booster charge 14 is not altered substantially.

In a second preferred embodiment, the booster charge 14 comprises a powdered zirconium/nickel alloy, an organic binder, and an oxidizer material. The proportions of zirconium and nickel in the zirconium/nickel alloy are not critical; any proportion may be used that is readily available and that bums easily after the ignition sensitivity threshold has been reached. Preferably, the composition of the zirconium/nickel alloy ranges between 70% zirconium/30% nickel to 30% zirconium/70% nickel. As the percentage of zirconium in the alloy increases relative to the percentage of nickel, the ignition sensitivity threshold decreases. Advantageously, a zirconium/nickel alloy in accordance with MIL-Z-11410, composed of 70±3% by weight of zirconium and 30±3% by weight of nickel, may be used. Preferably, the average particle size of the zirconium/nickel alloy is 4±2 microns. The zirconium/nickel alloy has an ignition sensitivity threshold on the order of magnitude of millijoules, which is several orders of magnitude higher than the microjoule-level threshold of known elements metal pyrotechnic fuels. The caloric value of the zirconium/nickel compound is about 1150 calories/gram, which is comparable to known elemental metal pyrotechnic fuels. Preferably, the organic binder is one sold under the registered trademark VITON® B, a fluoroelastomer terpolymer commercially available from DuPont Dow Elastomers LLC. However, the particular type of organic binder used is not critical; many different types of organic binder are known, and selection of an appropriate organic binder is within the knowledge of one skilled in the art. Preferably, the oxidizer material is potassium perchlorate. In the second preferred embodiment, the booster charge 14 comprises substantially 55% by weight of powdered zirconium/nickel alloy, substantially 3% by weight of VITON® B binder, and substantially 42% by weight of potassium perchlorate. However, other proportions may be used so long as the ignition sensitivity threshold and burn rate of the booster charge 14 is not altered substantially.

Both the $BaAl_4$ compound and the zirconium/nickel alloy have a higher ignition sensitivity threshold than powdered elemental metals because the components of these pyrotechnic fuels must be separated for the reaction to start. That is, when ignition energy is applied to the $BaAl_4$ compound, that energy first goes to break the chemical bonds between the barium atoms and the aluminum atoms in the $BaAl_4$ molecules. Only after that dissociation will the aluminum atoms and the barium atoms begin to combust separately. Similarly, when ignition energy is applied to the zirconium/nickel alloy, that energy first goes to dissociate the zirconium atoms from the nickel atoms. Unlike the $BaAl_4$ compound, the atoms of zirconium and nickel in the zirconium/nickel alloy do not form chemical bonds with one another; rather, they are held together by mechanical van der Waals forces. After the ignition energy overcomes the van der Waals forces holding the zirconium atoms and the nickel atoms together, they begin to combust separately. In contrast, metals in elemental metal pyrotechnic fuels exist in an atomic state and need not dissociate from other atoms before combusting. So, when ignition energy is applied to an elemental metal fuel, that energy is directed to igniting the metal atoms, not separating them. For this reason, known elemental metal fuels have an ignition sensitivity threshold much lower than that of the present invention.

Although the higher ignition threshold makes the $BaAl_4$ compound and the zirconium/nickel alloy attractive pyrotechnic fuels from the standpoint of safety, there is a tradeoff with regard to ignition time. If the $BaAl_4$ compound or the zirconium/nickel alloy are used in the igniter charge 6, ignition generally takes approximately 8–10 milliseconds after sufficient current is applied to the bridge wire 8. Using prior art elemental powder fuels, ignition generally takes approximately 2 milliseconds after sufficient current is applied to the bridge wire 8. Thus, the $BaAl_4$ compound and zirconium/nickel alloy may not be suitable for use in the igniter charge 6 where a very rapid ignition time is required from the igniter charge 6.

However, the $BaAl_4$ compound and zirconium/nickel alloy are advantageously used in the booster 12. When the igniter charge 6 ignites and burns, it generates a burst of high pressure and heat that provide significantly more ignition energy to the booster charge 14 than would an electric current sent through a wire into the booster charge 14. That burst of pressure and heat imparts enough ignition energy to the booster charge 14 to take it over the ignition sensitivity threshold rapidly, thereby causing the booster charge 14 to ignite and burn quickly. Thus, the time delay before ignition for $BaAl_4$ and zirconium/nickel, as compared to elemental powdered metal fuels, is minimized or eliminated altogether when $BaAl_4$ and zirconium/nickel are used in a booster 12 where a pressure and/or heat spike from an igniter provide ignition energy.

While it is preferred to use either the $BaAl_4$ compound or the zirconium/nickel alloy in the booster charge 14, they may be combined in the booster charge 14 if desired. Since the $BaAl_4$ compound and the zirconium/nickel alloy have a relatively high ignition sensitivity threshold, they are safer to handle during manufacturing. Moreover, since the igniter charge is smaller than the booster charge, the overall safety in manufacturing is improved, without degrading the effectiveness of the pyrotechnic system.

While this disclosure has described the use of powdered metal compound and alloy fuels in pyrotechnic devices, such fuels are not limited to pyrotechnic applications, and it is contemplated that such may also be useful in other applications where it is desirable to utilize a powdered metal compound or alloy fuel having a relatively high ignition sensitivity threshold.

Preferred powdered metal pyrotechnic fuels, and many of their attendant advantages, have thus been disclosed. It will be apparent, however, that various changes may be made in the materials and compositions without departing from the spirit and scope of the invention, the materials and compositions hereinbefore described being merely a preferred or exemplary embodiment thereof. Therefore, the invention is not to be restricted or limited except in accordance with the following claims and their legal equivalents.

What is claimed is:

1. A pyrotechnic mixture, comprising:

$BaAl_4$ compound in powdered form;

an organic binder material; and an oxidizer material.

2. The pyrotechnic mixture of claim 1, wherein the $BaAl_4$ compound comprises substantially 52% by weight of the pyrotechnic mixture.

3. The pyrotechnic mixture of claim 1, wherein the $BaAl_4$ compound includes substantially 56% by weight of barium and substantially 44% by weight of aluminum.

4. The pyrotechnic mixture of claim 1, wherein the powdered $BaAl_4$ compound has an average particle size of substantially 16 microns or less.

5. The pyrotechnic mixture of claim 1, wherein the organic binder comprises substantially 3% by weight of the pyrotechnic mixture.

6. The pyrotechnic mixture of claim 1, wherein the oxidizer material is potassium perchlorate.

7. The pyrotechnic mixture of claim 1, wherein the oxidizer material comprises substantially 45% by weight of the pyrotechnic mixture.

8. A pyrotechnic mixture, comprising:

$BaAl_4$ compound in powdered form comprising substantially 56% by weight of barium and substantially 44% by weight of aluminum and having an average particle size of 16 microns or less, the $BaAl_4$ compound being substantially 52% by weight of the pyrotechnic mixture;

an organic binder material, being substantially 3% by weight of the pyrotechnic mixture; and potassium perchlorate, being substantially 45% by weight of the pyrotechnic mixture.

* * * * *